US010766744B2

(12) United States Patent
Hägg et al.

(10) Patent No.: US 10,766,744 B2
(45) Date of Patent: Sep. 8, 2020

(54) ELEVATOR ARRANGEMENT AND METHOD

(71) Applicant: KONE Corporation, Helsinki (FI)

(72) Inventors: Jori Hägg, Helsinki (FI); Gabriel Ciuculescu, Helsinki (FI)

(73) Assignee: KONE CORPORATION, Helsinki (FI)

( * ) Notice: Subject to any disclaimer, the term of this patent is extended or adjusted under 35 U.S.C. 154(b) by 20 days.

(21) Appl. No.: 15/994,237

(22) Filed: May 31, 2018

(65) Prior Publication Data

US 2018/0354753 A1 Dec. 13, 2018

(30) Foreign Application Priority Data

Jun. 9, 2017 (EP) ..... 17175204

(51) Int. Cl.
*B66B 11/00* (2006.01)
*B66B 9/00* (2006.01)
(Continued)

(52) U.S. Cl.
CPC ..... *B66B 11/0005* (2013.01); *B66B 9/00* (2013.01); *B66B 19/00* (2013.01); *E04G 3/24* (2013.01); *E04G 3/28* (2013.01); *E04G 5/14* (2013.01); *E04G 21/32* (2013.01); *E04G 2003/286* (2013.01)

(58) Field of Classification Search
CPC ..... B66B 11/0005; B66B 9/00; B66B 19/00; B66B 19/005; B66B 19/04; E04G 3/24; E04G 3/28; E04G 5/14; E04G 2003/286
See application file for complete search history.

(56) References Cited

U.S. PATENT DOCUMENTS 3,759,349 A * 9/1973 Sieffert ..... B66B 9/187 52/745.2
3,907,066 A * 9/1975 Newton ..... E04G 3/24 182/112
(Continued)

FOREIGN PATENT DOCUMENTS

CA 2916436 A1 * 1/2015 ..... B66B 19/005
DE 202016103634 U1 * 11/2016 ..... B66B 19/005
(Continued)

OTHER PUBLICATIONS

Search Report issued in European priority application 17175204.1, dated Jan. 2, 2018.

*Primary Examiner* — Katherine W Mitchell
*Assistant Examiner* — Candace L Bradford
(74) *Attorney, Agent, or Firm* — Birch, Stewart, Kolasch & Birch, LLP

(57) ABSTRACT

An elevator arrangement, in particular a construction time elevator arrangement, includes a hoistway; an elevator car mounted in the hoistway; and a vertically movable support structure in the hoistway for supporting the elevator car, the movable support structure being mounted above the elevator car in the hoistway. The vertically movable support structure includes a first working platform, having a planar working area, and a protective cover above the first working platform for protecting elevator components and/or people below it from falling objects. The protective cover covers most of the cross section of the hoistway.

19 Claims, 3 Drawing Sheets

(51) Int. Cl.

| | |
|---|---|
| ***B66B 19/00*** | (2006.01) |
| ***E04G 5/14*** | (2006.01) |
| ***E04G 21/32*** | (2006.01) |
| ***E04G 3/24*** | (2006.01) |
| ***E04G 3/28*** | (2006.01) |

(56) References Cited

U.S. PATENT DOCUMENTS

| | | | | |
|---|---|---|---|---|
| 5,230,404 | A * | 7/1993 | Klein | B66B 19/00 187/414 |
| 2006/0201750 | A1* | 9/2006 | Hashiguchi | B66B 11/0045 187/266 |
| 2006/0278472 | A1* | 12/2006 | Kenton | E06B 11/00 182/113 |
| 2013/0118838 | A1* | 5/2013 | Plathin | D07B 1/02 187/251 |
| 2013/0248299 | A1* | 9/2013 | Perala | B66B 11/00 187/359 |
| 2014/0013562 | A1* | 1/2014 | Nakamura | B66B 11/0476 29/402.01 |
| 2016/0152442 | A1* | 6/2016 | Weber | B66B 19/00 187/359 |
| 2017/0166419 | A1* | 6/2017 | Rasanen | B66B 19/005 |
| 2017/0327348 | A1* | 11/2017 | Blasi | B66B 19/005 |
| 2018/0186607 | A1* | 7/2018 | Ratia | B66B 19/04 |

FOREIGN PATENT DOCUMENTS

| | | | |
|---|---|---|---|
| EP | 1270489 | A1 | 1/2003 |
| WO | WO 2010/010226 | A1 | 1/2010 |

* cited by examiner

ELEVATOR ARRANGEMENT AND METHOD

FIELD OF THE INVENTION

The invention relates an elevator arrangement and a method, and particularly to construction time protection of persons and/or components located in a lower portion of a hoistway of an elevator.

BACKGROUND OF THE INVENTION

In connection with so-called jump-lifts, the bottom part of an elevator hoistway is taken into use before the building has been completed. In this case the upper parts of the building as well as the top part of the elevator hoistway can be constructed at the same time as an elevator moving in the bottom part of the elevator hoistway already serves people on the lower floors of the building. Generally in jump-lifts the elevator car moving in the lower parts of the elevator hoistway is supported and moved during construction-time use with a hoisting machine supported on a vertically movable support structure in the elevator hoistway. The installation work in the upper parts of the elevator hoistway above this vertically movable support structure is done from a movable platform or corresponding in the elevator hoistway, which installation work comprises, among other things, the installation of guide rails and electrification in the elevator hoistway.

When the elevator hoistway under construction above the vertically movable support structure has reached a sufficient stage of completion, the completed part of the elevator hoistway can be taken into use. In this stage a jump is performed, wherein the vertically movable support structure is hoisted higher in the elevator hoistway. Thereafter, the car can reach a higher position than before the jump and start to serve additional floors.

In this the elevator arrangements as described above, construction of the upper part of the elevator shaft and installation of elevator components in the shaft can be a safety risk for the people and elevator components. Objects, such as installation tools or construction parts, can fall from the upper parts of the hoistway, and hit and damage people or elevator components.

In prior art document WO2010010226 A1, a separation structure has been proposed to be installed within the upper parts of the hoistway above movable support structure to limit the movement of the working platform. The limiting structure has been provided with a safety net, plate, grille or equivalent to stop falling objects. A drawback of this solution has been that it has been inflexible to use as the mounting of the support structure has required time, a certain hoistway structure and space in the hoistway.

BRIEF DESCRIPTION OF THE INVENTION

The object of the invention is to introduce a new construction time elevator arrangement and a method for constructing an elevator. An object is to introduce a solution by which one or more of the above defined problems of prior art and/or problems discussed or implied elsewhere in the description can be solved. An object is particularly to introduce a solution which provides construction time protection safely, while being flexible to use at all stages of a method aiming to raise the moving range of the elevator car. Embodiments are presented, inter alia, wherein these objects are achieved with a simple structure allowing vast protective coverage of the hoistway with a solution that does not disturb hoisting of a moveable support structure.

It is brought forward a new elevator arrangement, in particular a construction time elevator arrangement, comprising a hoistway; an elevator car mounted in the hoistway; a vertically movable support structure in the hoistway for supporting the elevator car, the movable support structure being mounted above the elevator car in the hoistway; the vertically movable support structure comprising a first working platform, having a planar working area, and a protective cover above the first working platform for protecting elevator components and/or people below it from falling objects, which protective cover covers most of the cross section of the hoistway. With this solution one or more of the above mentioned objects can be achieved. Particularly, the lower parts of the hoistway can thus be separated from the hoistway portion under construction simply, space efficiently and safely, the protection being flexible to use at all stages of a method aiming to raise the moving range of the elevator car. Preferable further details are introduced in the following, which further details can be combined with the elevator arrangement individually or in any combination.

In a preferred embodiment, the protective cover covers substantially completely the planar working area of the first working platform and the elevator car.

In a preferred embodiment, the hoistway has a first side wall, and a second side wall; the elevator car being mounted in the hoistway between the first side wall and the second side wall, a first gap being formed between the car and the first side wall, and a second gap being formed between the car and the second side wall; the protective cover extending over the first and second gap covering most of the cross sectional areas of the first and second gap.

In a preferred embodiment, the elevator comprises vertically oriented car guide rails for guiding the movement of the elevator car, said guide rails comprising a first guide rail extending through said first gap, and a second guide rail extending through said second gap.

In a preferred embodiment, the protective cover extends in width direction of the hoistway closer to the first side wall than the first guide rail, and closer to the second side wall than the second guide rail.

In a preferred embodiment, the protective cover extends between the first side wall and the first guide rail, and between the second side wall and the second guide rail, covering at least part of the gap formed between the first side wall and the first guide rail, and covering at least part of the gap formed between the second side wall and the second guide rail.

In a preferred embodiment, the car guide rails extend continuously from below the vertically movable support structure above the vertically movable support structure.

In a preferred embodiment, the protective cover comprises a first opening through which the first guide rail extends, and a second opening through which the second guide rail extends.

In a preferred embodiment, protective cover comprises one or more displaceable cover parts forming part of the periphery of the protective cover, which displaceable cover parts are displaceable for reducing size of the protective cover and thereby for increasing free space beside the protective cover, in particular thereby creating a gap between the protective cover and an adjacent side wall of the hoistway. Hereby, the protective cover can be shifted into a state where it disturbs hoisting of the moveable support structure in the hoistway. Hoistway portion above the moveable support structure comprises components that could otherwise be at risk of being hit by parts of the protective cover. The presented solution facilitates tight protective coverage during use of the elevator car for transporting and hoisting thereof with sufficient clearance relative to stationary elevator components, such as guide rails of the elevator car for instance.

In a preferred embodiment, said displaceable cover parts of the protective cover include one or more displaceable cover parts, which extend over the first and second gap.

In a preferred embodiment, the one or more displaceable cover parts include a displaceable cover part extending between the first side wall and the first guide rail covering at least part of the gap formed between the first side wall and the first guide rail. The one or more displaceable cover parts preferably moreover include a displaceable cover part extending between the second side wall and the second guide rail and covering at least part of the gap formed between the second side wall and the second guide rail. Displaceabitily of the cover part(s) positioned like this allows tight protection of the hoistway while allowing also free hoisting of the vertically moveable support structure in cases where guide rails are supported on a hoistway wall with brackets extending across the space between the guide rail and a hoistway wall.

In a preferred embodiment, the aforementioned one or more displaceable cover parts include in depth direction of the hoistway on both sides of the first guide rail a displaceable cover part extending in width direction of the hoistway closer to the first side wall than the first guide rail.

In a preferred embodiment, the one or more displaceable cover parts include in depth direction of the hoistway on both sides of the second guide rail a displaceable cover part extending in width direction of the hoistway closer to the second side wall than the second guide rail.

In a preferred embodiment, the one or more displaceable cover parts are displaceable cover plates. Generally, the displaceable cover parts are preferably rigid parts. They can be made of metal, which is simple and cheap, or alternatively they can have a sandwich structure comprising metal and/or non-metallic material. The sandwich structure facilitates impact absorbing properties of the displaceable cover parts.

In a preferred embodiment, the protective cover comprises a second working platform. The protective cover is then preferably provided with a balustrade bordering a horizontal planar working area of the second working platform. The balustrade preferably stands on the second working platform. The second working platform preferably forms partially the upper face of the moveable support structure.

In a preferred embodiment, the first and/or second working platform is preferably such that it comprises a horizontal planar upper face area on which a person can stand, having more than 1 square meter total area, wherein a rectangle fits, the shortest side of the rectangle being more than 50 cm in size.

In a preferred embodiment, the second working platform covers most of the cross section of the hoistway.

In a preferred embodiment, the displaceable cover parts are mounted on the second platform.

In a preferred embodiment, the protective cover comprises a second working platform having a first side, which is in width direction of the hoistway beside the first side wall of the hoistway, and a second side, which is in width direction of the hoistway beside a second side wall of the hoistway.

In a preferred embodiment, one or more of the displaceable cover parts are mounted on the second working platform such that they overlap with the second working platform.

In a preferred embodiment, one or more of the displaceable cover parts are anchored immovably on the second working platform with releasable tightening means.

In a preferred embodiment, one or more of the displaceable cover parts are mounted on the second working platform via a hinge. This can advantageously be implemented such that the one or more of the displaceable cover parts are mounted on the second working platform via a hinge, such that it/they can be pivoted around a horizontal axis upwards from a first horizontal position wherein the cover part(s) in question protrudes sideways from the vertically movable support structure, to a second horizontal position wherein the displaceable cover part(s) in question are pivoted to point (by their distal ends) towards the central parts of the movable support structure.

In a preferred embodiment, one or more of the displaceable cover parts are mounted on the second working platform linearly slidably in horizontal direction, such that it/they can be slided from a first position wherein the cover part(s) in question protrudes sideways from the vertically movable support structure, to a second position wherein the cover part(s) in question are retracted towards the center of the movable support structure.

In a preferred embodiment, the elevator arrangement comprises a hoisting means for hoisting the vertically movable support structure higher in the hoistway.

In a preferred embodiment, the elevator arrangement comprises one or more hoisting ropes for suspending the elevator car, the one or more hoisting ropes passing around one or more rope wheels mounted on the vertically movable support structure, most preferably on the first working platform.

In a preferred embodiment, the elevator arrangement comprises a motor for rotating at least one rope wheel around which the one or more hoisting ropes pass. The motor is preferably mounted on the vertically movable support structure, most preferably on the first working platform.

In a preferred embodiment, the hoistway is inside a building under construction.

In a preferred embodiment, the hoistway is a permanent hoistway, meaning it will not be removed but continue to serve as a hoistway once the construction of the building is finished.

In a preferred embodiment, the elevator arrangement comprises a moveable working platform above the movable support structure.

In a preferred embodiment, the elevator arrangement comprises a counterweight. The protective cover then preferably extends over the counterweight covering it at least partially, preferably substantially completely. The counterweight is preferably on the back-side of the elevator car, i.e. in depth directional side of the elevator car, between the path of the elevator car and the back wall of the hoistway. The elevator car preferably comprises a door opening towards the front wall of the hoistway.

In a preferred embodiment, the elevator arrangement comprises a counterweight, and one or more ropes hoisting ropes interconnect the elevator car with the counterweight.

In a preferred embodiment, the elevator car is in construction time use for transporting passengers and/or goods below said moveable support structure.

In a preferred embodiment, the elevator arrangement comprises a releasable mounting means for mounting the movable support structure stationarily in the hoistway. The releasable mounting means are preferably supportable directly on a hoistway structure, e.g. hoistway wall and/or landing sill, or directly on the guide rails and/or on guide rail brackets, wherein said guide rails are the car guide rails and/or the counterweight guide rails. The releasable mounting means are preferably arranged in the mounted state to bear the whole weight of the vertically moveable support structure.

In a preferred embodiment, the releasable mounting means are preferably separate from the protective cover. Preferably, the releasable mounting means are mounted below the protective cover, whereby operation and/or inspection thereof can be performed under the protection of the protective cover. The releasable mounting means are preferably mounted on a beam structure forming a frame of the first working platform.

It is also brought forward a new method, in particular a method for constructing an elevator, the method comprising providing an elevator arrangement as defined anywhere above; and using the elevator car for transporting passengers and/or goods; and thereafter hoisting the movable support structure higher in the hoistway; and thereafter using the elevator car again for transporting passengers and/or goods. With this solution one or more of the above mentioned objects can be achieved. Preferable further details are introduced in the following, which further details can be combined with the method individually or in any combination.

In a preferred embodiment, the method comprises after said using and before said hoisting, displacing one or more displaceable cover parts of the protective cover for reducing size of the protective cover, and in particular for increasing free space beside the protective cover, in particular thereby creating a gap between the protective cover and adjacent side wall(s) of the hoistway.

In a preferred embodiment, the aforementioned displacing comprises displacing one or more displaceable cover parts of the protective cover, which one or more displaceable cover parts extend over the first and/or second gap.

In a preferred embodiment, the aforementioned displacing comprises displacing a displaceable cover part extending between the first side wall and the first guide rail covering at least part of the gap formed between the first side wall and the first guide rail, and/or displacing a displaceable cover part extending between the second side wall and the second guide rail and covering at least part of the gap formed between the second side wall and the second guide rail.

In a preferred embodiment, the method comprises after said using and before said hoisting, demounting the movable support structure, e.g. by releasing a releasable mounting means for mounting the movable support structure stationarily in the hoistway.

In a preferred embodiment, the method comprises after said hoisting, remounting the movable support structure, e.g. by aid of the releasable mounting means for mounting the movable support structure stationarily in the hoistway.

In a preferred embodiment, the method comprises after said hoisting, returning the displaced displaceable cover parts of the protective cover back to the position where they were prior the displacing, e.g. back to extend over the first and/or second gap.

In a preferred embodiment, the method comprises during said first or second using installing elevator components in the hoistway above the protective cover.

In a preferred embodiment, the installing comprises installing an electric cable into the hoistway above the protective cover.

In a preferred embodiment, the installing an electric cable into the hoistway above the protective cover comprises feeding electric cable from a reel placed on the protective cover.

In a preferred embodiment, the installing comprises using the working platform of the protective cover by one or more fitters for standing.

In a preferred embodiment, the method comprises during said hoisting, extending rope length of the one or more hoisting ropes of the elevator system, preferably by feeding hoisting rope via an openable rope clamp. For this purpose, one end of each hoisting rope can extend via such a rope clamp to a rope reel storing hoisting rope.

In a preferred embodiment, the displaceable cover plates are not bearing structures of the vertically movable support structure. Thereby, they are preferably separate from the releasable mounting means mentioned earlier above. The releasable mounting means are preferably positioned below the protective cover, whereby operation and inspection thereof can be performed under the protection of the protective cover.

The elevator arrangement is preferably suitable for transporting passengers and/or goods. The elevator arrangement is preferably such that the car thereof is vertically movable and configured to serve two or more vertically displaced landings. The elevator arrangement is furthermore preferably configured to control movement of the car in response to signals from user interfaces located at landing(s) and/or inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
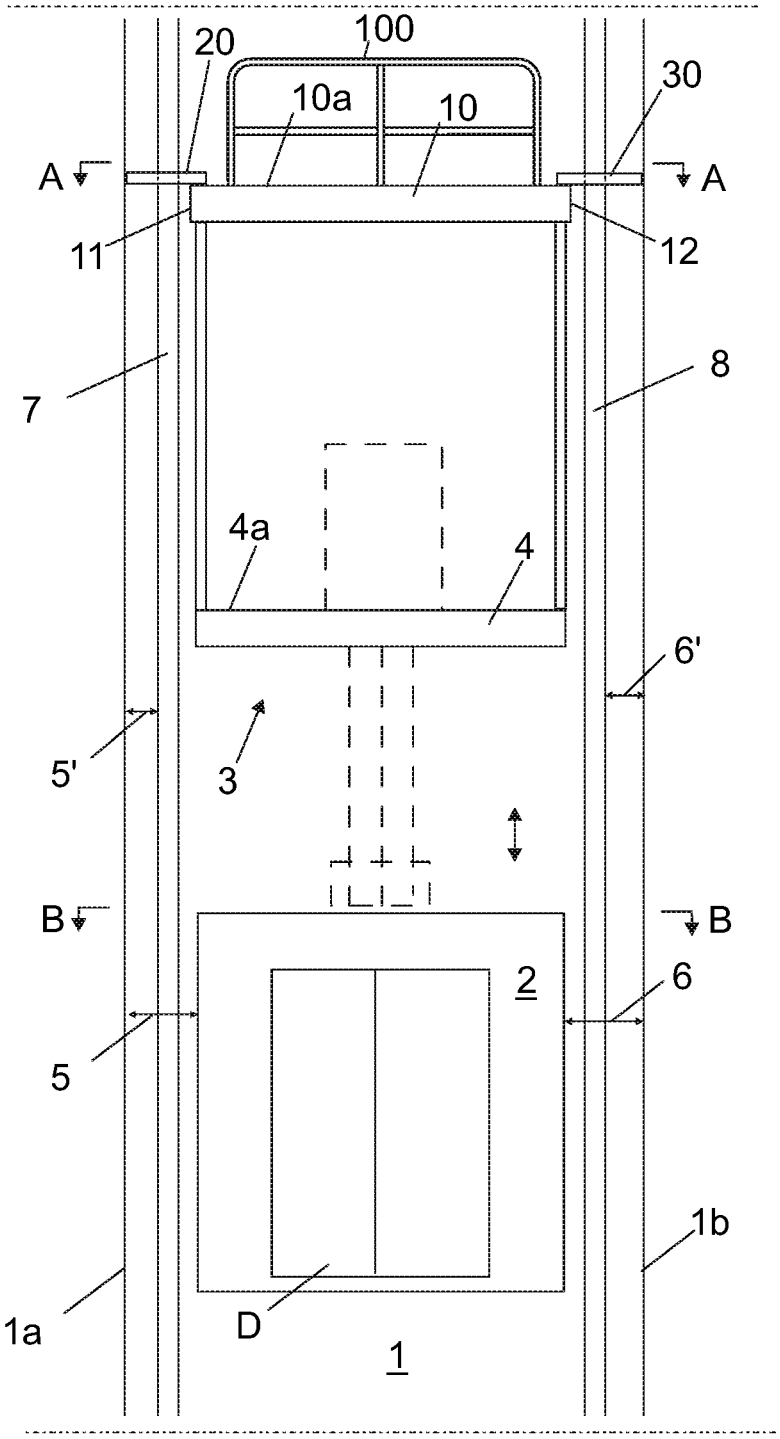
FIG. 1 illustrates an embodiment of a construction time elevator arrangement according to the invention.
Figure 2:
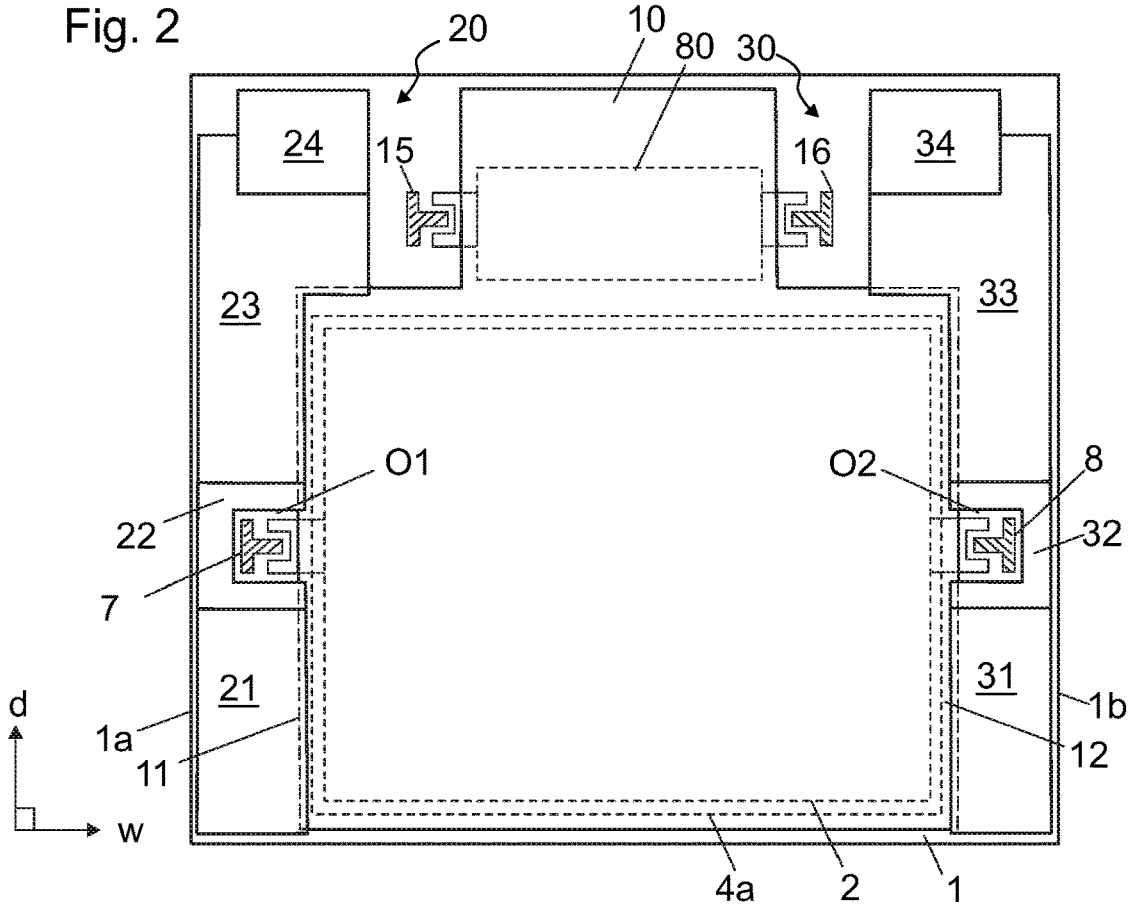
FIG. 2 illustrates a cross sectional view A-A of FIG. 1.
Figure 3:
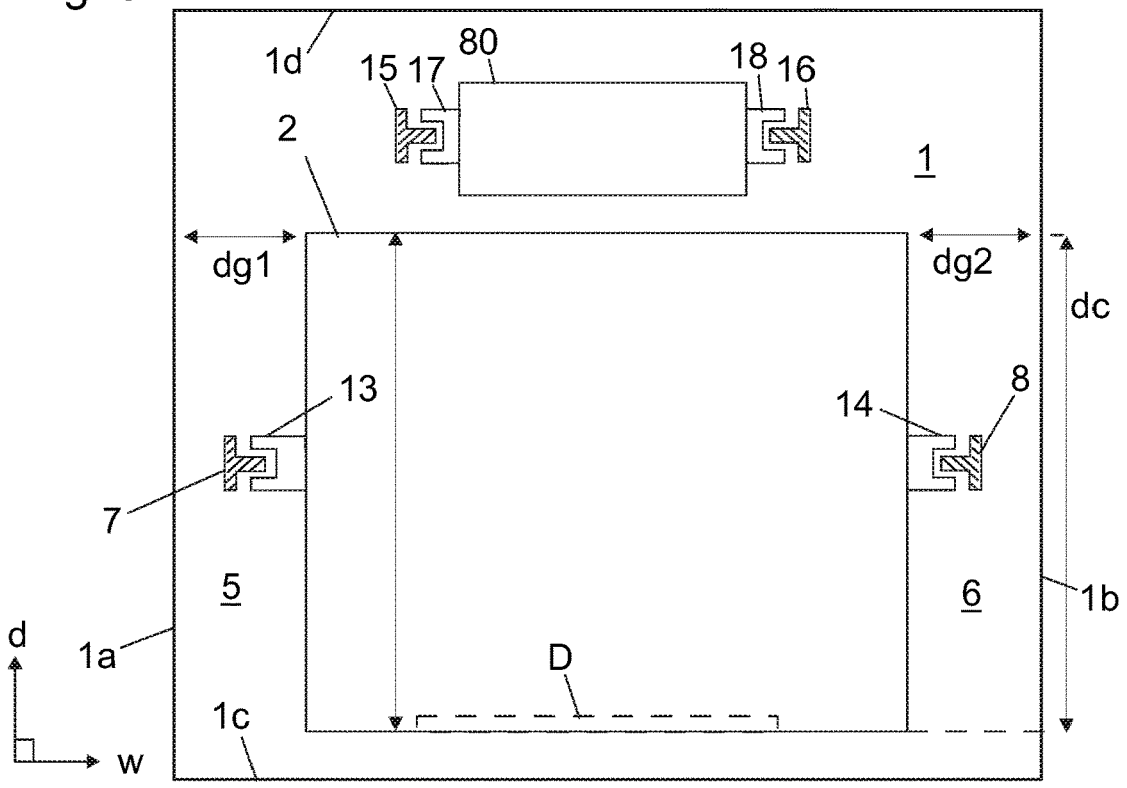
FIG. 3 illustrates a cross sectional view B-B of FIG. 1.

FIG. 1 illustrates a preferred embodiment of an elevator arrangement, in particular a construction time elevator arrangement. FIGS. 2 and 3 illustrate cross sections A-A and B-B of FIG. 1, respectively. The elevator arrangement presented comprises a hoistway 1 formed inside a building, an elevator car 2 mounted in the hoistway 1, and a vertically movable support structure 3 in the hoistway 1 supporting the elevator car 2. The movable support structure 3 is in FIG. 1 mounted above the elevator car 2 in the hoistway 2 stationarily by mounting means (not showed), which are releasable so as to enable unblocked hoisting of the movable support structure 3 in the hoistway 1. Said mounting means can be any kind suitable for purpose, e.g. any kind known from prior art, such as retractable support beams, for example. Vertical movability of the support structure 3 provides that the moving range of the elevator car can be stepwise extended to reach higher in the hoistway 1, the elevator arrangement thus being suitable to form a so called jump-lift.

The vertically movable support structure 3 comprises a first working platform 4, having a planar working area 4*a*, and a protective cover 10, 20, 30 above the first working platform 4 for protecting elevator components and/or people below it from falling objects. The protective cover 10, 20, 30 covers most of the cross sectional area of the hoistway 1, meaning more than 50% of the cross sectional area of the hoistway 1, however more preferably more than 70%, even more preferably more than 80% of the cross sectional area of the hoistway 1.

Of the elevator components, it is preferable that the protective cover 10, 20, 30 covers substantially completely, meaning that at least 90% of the cross sectional area of the component is covered, the planar working area 4*a* of the first working platform 4 and the elevator car 2, whereby these components are protected from objects falling directly vertically from above the movable support structure 3.

In the preferred embodiment presented, the hoistway 1 has a front wall 1*c*, back wall 1*d*, a first side wall 1*a*, and a second side wall 1*b*; the elevator car 2 being mounted in the hoistway 1 between the first side wall 1*c*, and the second side wall 1*d*, a first gap 5 being formed between the car 1 and the first side wall 1*c*, and a second gap 6) being formed between the car 1 and the second side wall 1*d*; the protective cover 10, 20, 30 extending over the first and second gap 5, 6 covering most of the cross sectional areas of the first and second gap 5, 6, i.e. more than 50% of the cross sectional areas of the first and second gap 5, 6, however more preferably more than 70%, even more preferably more than 80% of the cross sectional areas of the first and second gap 5, 6.

The protective cover 10, 20, 30 can comprise openings for allowing placement of elements to extend through it, such as elevator car guide rails or counterweight guide rails, as will be later explained.

In the preferred embodiment, the elevator comprises vertically oriented car guide rails 7, 8 for guiding the movement of the elevator car 2. In the preferred embodiment, said guide rails 7, 8 comprises a first guide rail 7 extending through said first gap 5, and a second guide rail 8 extending through said second gap 6. The car 1 is provided with guide members 13, 14 leaning on said guide rails 7,8.

The protective cover 10, 20, 30 aims to cover substantially whole width of the hoistway 1. For this purpose, it extends in width direction w of the hoistway 1 closer to the first side wall 1*c* than the first guide rail 7, and closer to the second side wall 1*d* than the second guide rail 8. As can be seen in FIG. 2, the protective cover 10, 20, 30 extend in width direction w of the hoistway 1 closer to the first side wall 1*a* than the first guide rail 7, and in depth direction d of the hoistway 1 on both sides of the first guide rail 7. Hereby, it does not allow objects to fall into these portions of the first gap 5, nor to find their way downwards through these portions of the gap 5. Hereby, damaging of the guide members 13 of the car can also be made less likely, for instance. Likewise, as can be seen in FIG. 2, the protective cover 10, 20, 30 extend in width direction w of the hoistway 1 closer to the second side wall 1*b* than the second guide rail 8, and in depth direction d of the hoistway ion both sides of the second guide rail 8. Hereby, it does not allow objects to fall into these portions of the second gap 6, nor to find their way downwards through these portions of the gap 6. Hereby, damaging of the guide members 14 of the car 1 can also be made less likely, for instance.

Preferably, the protective cover 10, 20, 30 extends between the first side wall 1*c* and the first guide rail 7, and between the second side wall 1*d* and the second guide rail 8, covering at least part of the gap 5' formed between the first side wall 1*c* and the first guide rail 7, and covering at least part of the gap 6' formed between the second side wall 1*d* and the second guide rail 8. Hereby, it does not allow objects to fall into these portions of the gaps 5,6, nor to find their way downwards through these portions of the gaps 5,6. Hereby, damaging of the guide members 13,14 of the car 1 can also be made less likely, for instance. Covering of the gaps 5' and 6' are advantageously implemented by aid of displaceable cover parts 22,32 as will be described later.

In the preferred embodiment, the car guide rails 7,8 extend continuously from below the vertically movable support structure 3 above the vertically movable support structure 3.

This is not necessary, but it provides that the car guide rail structure can be piled to extend higher during use of the elevator car 1, and the hoistway 1 portions located above the moveable support structure 3 will in this regard be ready already before the hoisting of the moveable support structure 3. Thus, the elevator arrangement will be ready for continuing its transporting of passengers with additional floors and extended serving zone swiftly after the moveable support structure 3 is remounted to its higher location in the hoistway 1, the service zone extending high in the hoistway space below the moveable support structure.

For the purpose of allowing the car guide rails 7,8 extend continuously from below the vertically movable support structure 3 above the vertically movable support structure 3, the protective cover 10, 20, 30 comprises a first opening O1 through which the first guide rail 7 extends, and a second opening O2 through which the second guide rail 8 extends.

In the preferred embodiment, the protective cover 10, 20, 30 comprises one or more displaceable cover parts 21-24, 31-34 forming part of the periphery of the protective cover 10, 20, 30, which displaceable cover parts are displaceable for reducing size of the protective cover 10, 20, 30 and thereby for increasing free space beside the protective cover 10, 20, 30, in particular thereby creating a gap between the protective cover 10, 20, 30 and the adjacent hoistway wall 1*a*,1*b*.

Preferably, said displaceable cover parts 21-24, 31-34 of the protective cover 10, 20, 30 include one or more displaceable cover parts 21-23, 31-33, which extend over the first and second gap 5, 6.

Preferably, the one or more displaceable cover parts 21-24, 31-34 include a displaceable cover part 22 extending between the first side wall 1*c* and the first guide rail 7 covering at least part of the gap 5' formed between the first side wall 1*c* and the first guide rail 7, and a displaceable cover part 32 extending between the second side wall 1*d* and the second guide rail 8 and covering at least part of the gap 6' formed between the second side wall 1*d* and the second guide rail 8.

Preferably, the one or more displaceable cover parts 21-24, 31-34 include in depth direction d of the hoistway 1 on both sides of the first guide rail 7 a displaceable cover part 21,23 extending in width direction w of the hoistway 1 closer to the first side wall 1*a* than the first guide rail 7. Likewise, preferably, the one or more displaceable cover parts 21-24, 31-34 include in depth direction d of the hoistway 1 on both sides of the second guide rail 8 a displaceable cover part 31,33 extending in width direction w of the hoistway 1 closer to the second side wall 1*b* than the second guide rail 8.

Generally, the one or more displaceable cover parts 21-24, 31-34 can be displaceable cover plates, for example. Generally, the displaceable cover parts 21-24, 31-34 are preferably rigid parts, made of rigid material. They can be made of metal, which is simple and cheap, or alternatively they can have a sandwich structure comprising metal and/or non-metallic material. The sandwich structure facilitates impact absorbing properties of the displaceable cover parts 21-24, 31-34.

The protective cover 10, 20, 30 comprises a second working platform 10. Thus the protective cover provides the arrangement protection against falling objects and also a platform on which the fitters can safely stand work. The protective cover 10, 20, 30 is then preferably provided with a balustrade 100 bordering a horizontal planar working area 10*a* of the second working platform 10. The balustrade 100 preferably stands on the second working platform 10. The aforementioned displaceable cover parts 21-24, 31-34 are preferably mounted on the second platform 10. This is preferably done so that the displaceable cover parts 21-24, 31-34 and the second platform 10 together form a substantially planar structure. The one or more displaceable cover parts 21-24, 31-34 are preferably mounted on the second working platform 10 such that they overlap with the second working platform 10. Thereby, number and size of gaps through which objects can fall can be reduced.

The second working platform 10 is preferably connected rigidly with the first working platform 4. It has a first side 11, which is in width direction w of the hoistway 1 beside the first side wall 1*a* of the hoistway 1, and a second side 12, which is in width direction w of the hoistway 1 beside a second side wall 1*b* of the hoistway 1.

The first and/or second working platform 4,10 is preferably such that it/they comprises a horizontal planar working area 4*a*,10*a* on which a person can stand, the horizontal planar working area 4*a*,10*a* having more than 1 square meter total area, wherein a rectangle fits, the shortest side of the rectangle being more than 50 cm in size.

Preferably, the second working platform 10 covers most of the cross sectional area of the hoistway 1, i.e. more than 50% of the cross sectional area of the hoistway 1.

Preferably, the one or more of the displaceable cover parts 21-24, 31-34 are mounted immovably on the second working platform 10 with releasable tightening means (not showed). Releasability provides that they can be released and thereafter displaced for the time of the hoisting of the movable support structure 3.

One or more of the displaceable cover parts (21-24, 31-34) can be mounted on the second working platform 10 via a hinge. This is preferably implemented such that the one or more of the displaceable cover parts (21-24, 31-34) are mounted on the second working platform (10) via a hinge, such that it/they can be pivoted around a horizontal axis upwards from a first horizontal position wherein the cover part(s) in question protrudes sideways from the vertically movable support structure (3), to a second horizontal position wherein the displaceable cover part(s) in question are pivoted to point (by their distal ends) towards the central parts of the movable support structure 3.

One or more of the displaceable cover parts 21-24, 31-34 can be mounted on the second working platform 10 linearly slidably in horizontal direction, such that it/they can be slided from a first position wherein the cover part(s) in question protrudes sideways from the vertically movable support structure 3, to a second position wherein the cover part(s) in question are retracted towards the central parts of the movable support structure 3.

Figure 4:
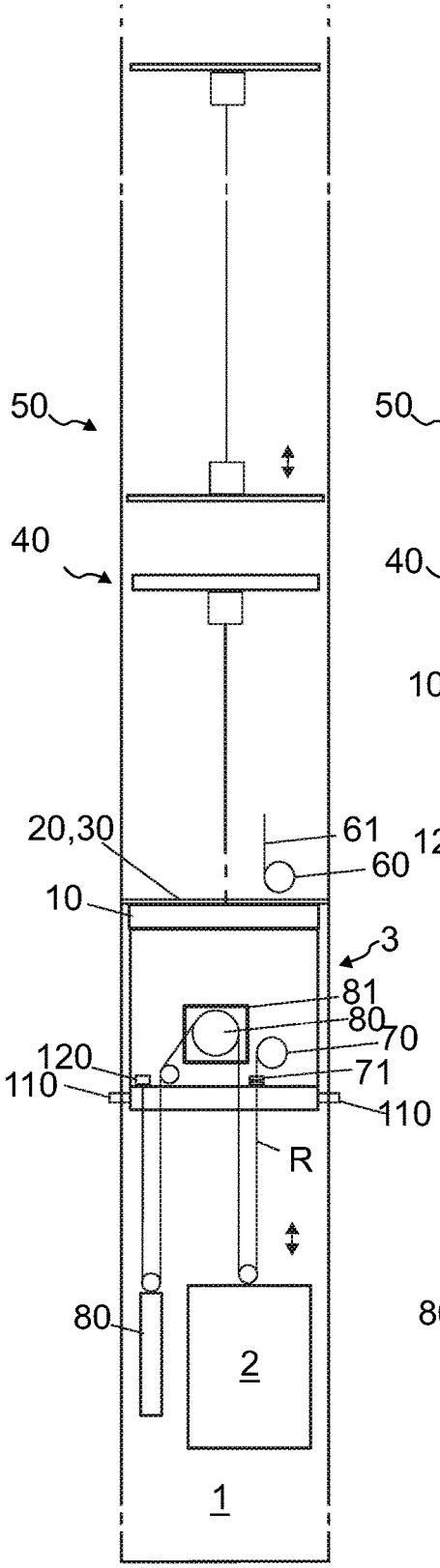
FIGS. 4-6 illustrate consecutive phases of a preferred embodiment of a method according to the invention.
Figure 5:
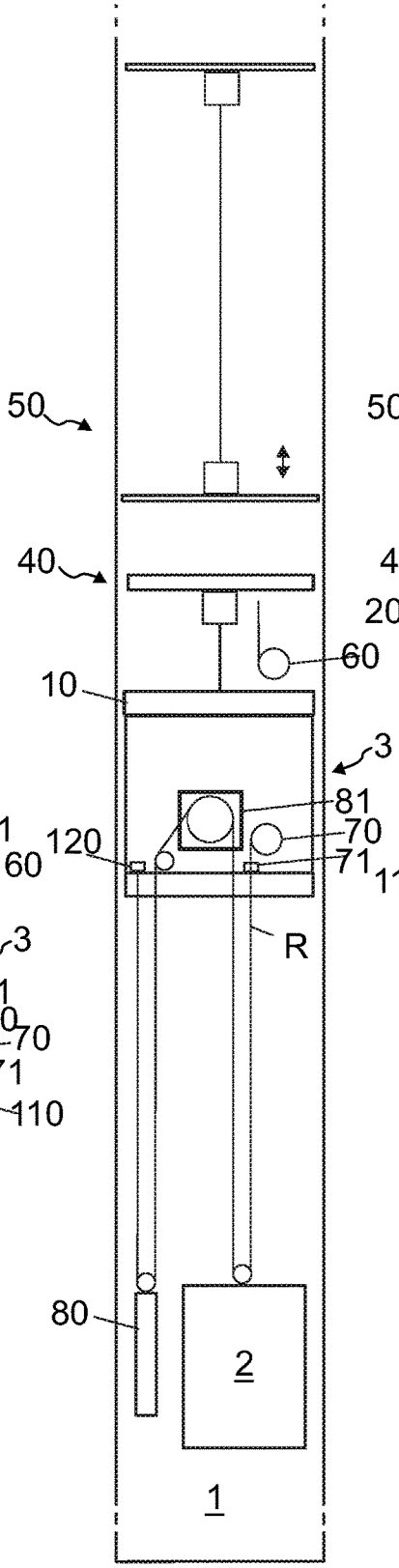
Figure 6:
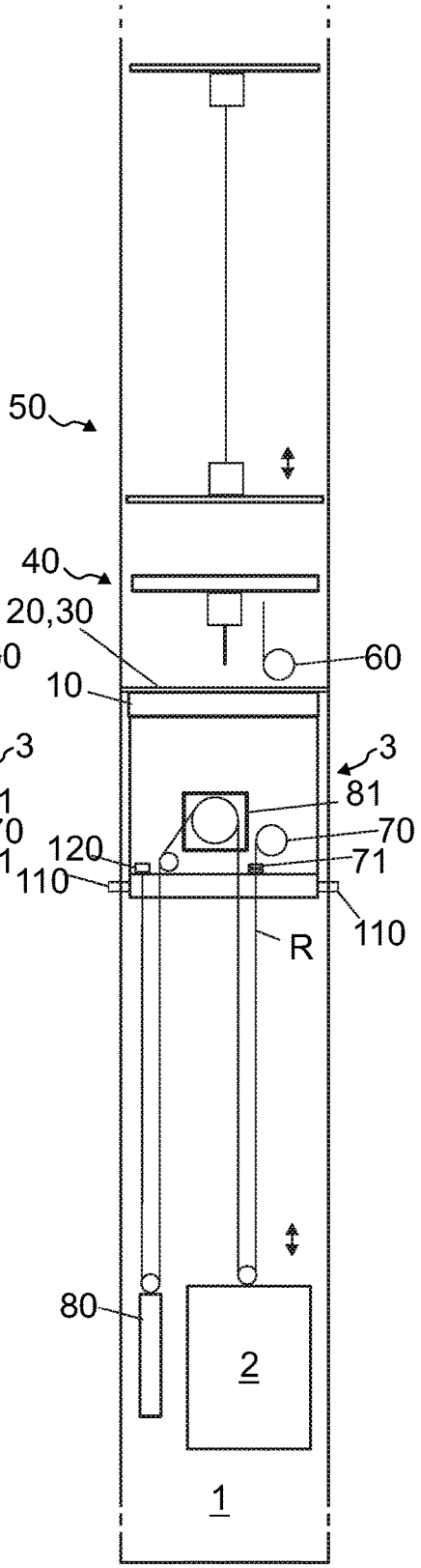

Further preferred features of the elevator arrangement are illustrated in FIGS. 4-6. As visible in FIGS. 4-6, the elevator arrangement comprises a hoisting means 40 for hoisting the vertically movable support structure 3 higher in the hoistway 1.

The elevator arrangement comprises one or more hoisting ropes R for suspending the elevator car 2, the one or more hoisting ropes R passing around one or more rope wheels 80 mounted on the vertically movable support structure 3, most preferably on the first working platform 4. For the purpose of using the ropes 81 for transmitting motive force to the car 1, the elevator arrangement comprises a motor 8 for rotating at least one rope wheel 80 around which the one or more ropes R pass. For the purpose of facilitating installation work in the upper parts of the hoistway, the elevator arrangement comprises a moveable working platform 50 above the movable support structure 3.

The elevator arrangement is preferably a counterweighted elevator, whereby it comprises a counterweight 80, as also visible in FIGS. 2 and 3. The one or more ropes hoisting ropes R interconnect the elevator car 2 with the counterweight 80. Preferably, the protective cover 10, 20, 30 extends over the counterweight 80 covering it at least partially, preferably substantially completely.

The layout of the elevator arrangement is preferably more specifically such that the counterweight 80 is on the backside of the elevator car 2, i.e. in depth directional side of the elevator car 2, between the traveling path of the elevator car 2 and the back wall 1*d* of the hoistway 1. The elevator car 2 comprises a door D, which preferably opens towards the front wall 1*c* of the hoistway 1.

In the preferred embodiment, the elevator comprises vertically oriented counterweight guide rails 15, 16 for guiding the movement of the counterweight 80. In the preferred embodiment, the counterweight 80 is arranged to travel between said counterweight guide rails 15,16 positioned at a distance from each other in width direction of the hoistway 1. The counterweight 80 is provided with guide members 17,18 leaning on the guide rails 15,16.

In the preferred embodiment, the counterweight guide rails 15,16 extend continuously from below the vertically movable support structure 3 above the vertically movable support structure 3. This is not necessary, but it provides that the guide rail structure can be piled during use of the elevator car 1, and the hoistway 1 portions located above the moveable support structure 3 will in this regard be ready already before the hoisting of the moveable support structure 3. Thus, the elevator arrangement will be ready for continuing its transporting of passengers with additional floors and extended serving zone swiftly after the moveable support structure 3 is remounted to its higher location in the hoistway 1, the service zone extending high in the hoistway space below the moveable support structure.

In the preferred embodiment, the protective cover 10, 20, 30 extends between the counterweight guide rails 15,16 extending continuously from below the vertically movable support structure 3 above the vertically movable support structure 3.

FIGS. 4-6 consecutive phases of a preferred embodiment of a method according to the invention. The method comprises providing an elevator arrangement as described anywhere above, and using the elevator car 2 for transporting passengers and/or goods. FIGS. 4-6 do not illustrate all the features of FIGS. 1-3, such as guide rails, but the arrangement of FIGS. 4-6 is preferably in line with FIGS. 1-3. The phase where the elevator car 2 is used for transporting passengers and/or goods is illustrated in FIG. 4. The elevator arrangement is as disclosed in FIGS. 1-3 and related description. After this phase, the method comprises hoisting the movable support structure 3 higher in the hoistway 1, as illustrated in FIG. 5. For safety reasons, the elevator car 2 is not used for transporting passengers and/or goods during said hoisting. After this phase, the method comprises using the elevator car 2 again for transporting passengers and/or goods as illustrated in FIG. 6.

The method preferably moreover comprises after said using and before said hoisting, displacing one or more displaceable cover parts 21-24, 31-34 of the protective cover 10, 20, 30 for reducing size of the protective cover 10, 20, 30 and thereby for increasing free space beside the protective cover 10, 20, 30, in particular thereby creating a gap between the protective cover 10, 20, 30 and the hoistway side wall 1*a*,1*b* adjacent to it. Said displacing preferably comprising displacing one or more displaceable cover parts 21-24, 31-34 of the protective cover 10, 20, 30, which displaceable cover parts 21-23, 31-33 extend over the first and second gap 5, 6.

The method preferably moreover comprises after said using and before said hoisting, demounting the movable support structure 3, e.g. by releasing a releasable mounting means 110 for mounting the movable support structure 3 stationarily in the hoistway 1.

The releasable mounting means 110 are preferably mounted below the protective cover 10, 20, 30, whereby operation and inspection thereof can be performed under the protection of the protective cover 10, 20, 30. The releasable mounting means 110 are preferably mounted on a beam structure forming a frame of the first working platform. The releasable mounting means 110 are preferably separate from the protective cover 10, 20, 30.

The method preferably moreover comprises after said hoisting, remounting the movable support structure 3. This can be done by aid of the releasable mounting means 110 for mounting the movable support structure 3 stationarily in the hoistway 1.

The method preferably moreover comprises after said remounting, returning the displaced displaceable cover parts 21-24, 31-34 of the protective cover 10, 20, 30 back to the position where they were prior the displacing, e.g. back to extend over the first and/or second gap 5, 6.

The method preferably moreover comprises during the first or second of the aforementioned using phases, installing elevator components in the hoistway 1 above the protective cover 10, 20, 30. The installing preferably comprises installing an electric cable 61 into the hoistway above the protective cover 10, 20, 30. The installing an electric cable 61 into the hoistway 1 above the protective cover 10, 20, 30 preferably comprises feeding electric cable from a reel (60) placed on the protective cover 10, 20, 30. Preferably, the installing comprises using the working platform 10 of the protective cover 10, 20, 30 by one or more fitters for standing.

The method preferably moreover comprises during or before said hoisting, extending rope length of the one or more hoisting ropes R of the elevator arrangement by feeding hoisting rope R via an openable rope clamp 71. One end of each hoisting rope R can extend via such a rope clamp 71 to a rope reel 70. The other end of each hoisting rope R can be fixed by a fixture 120 to a structure of the elevator arrangement without extending into a rope reel. The rope reel(s) 71 can be positioned as presented in FIGS. 4-6 on the moveable support structure 3, or in an alternative position, such as on the floor of the hoistway 1 or on a landing, for example.

In the application, several details for the arrangement and the method have been presented as preferred. This means that they are preferred, however they are not to be understood as necessary, because it may be that the arrangement and/or the method can be implemented also without them.

In the description above, the cross sectional areas of the first and second gap 5, 6 are defined by the depth dc of the car 1 and the distance dg1,dg2 between the elevator car 2 and each of the side walls 1*a*,1*b*. The cross sectional area of each first and second gap 5, 6 can be calculated by equation dc*dg1 and dc*dg2, respectively.

As mentioned said releasable mounting means can be any kind suitable for purpose, e.g. any kind known from prior art, such as retractable support beams, for example. In the examples presented, the releasable mounting means are supported directly on a hoistway structure, e.g. hoistway wall and/or landing sill. However, the releasable mounting means can alternatively be supported on the guide rails and/or their brackets, for example.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. An elevator arrangement, comprising:

a hoistway;

an elevator car mounted in the hoistway; and a vertically movable support structure in the hoistway for supporting the elevator car, the movable support structure being mounted above the elevator car in the hoistway, the vertically movable support structure comprising:

a first working platform, having a planar working area; and a protective cover above the first working platform for protecting elevator components and/or people below the first working platform from falling objects, the protective cover covering most of the cross section of the hoistway, wherein the protective cover comprises one or more displaceable cover parts forming part of the periphery of the protective cover, the displaceable cover parts being displaceable for increasing free space beside the protective cover, for creating a gap between the protective cover and an adjacent side wall of the hoistway.

2. The elevator arrangement according to claim 1, wherein the hoistway has a first side wall, and a second side wall, the elevator car being mounted in the hoistway between the first side wall and the second side wall, a first gap being formed between the car and the first side wall, and a second gap being formed between the car and the second side wall, the protective cover extending over the first and second gap covering most of the cross sectional areas of the first and second gap.

3. The elevator arrangement according to claim 2, wherein the elevator comprises vertically oriented car guide rails for guiding the movement of the elevator car, said guide rails comprising a first guide rail extending through said first gap, and a second guide rail extending through said second gap.

4. The elevator arrangement according to claim 3, wherein the protective cover extends in width direction of the hoistway closer to the first side wall than the first guide rail, and closer to the second side wall than the second guide rail.

5. The elevator arrangement according to claim 4, wherein the protective cover comprises a first opening through which the first guide rail extends, and a second opening through which the second guide rail extends.

6. The elevator arrangement according to claim 3, wherein the protective cover extends between the first side wall and the first guide rail, covering at least part of the gap formed between the first side wall and the first guide rail, and/or between the second side wall and the second guide rail, covering at least part of the gap formed between the second side wall and the second guide rail.

7. The elevator arrangement according to claim 6, wherein the car guide rails extend continuously from below the vertically movable support structure above the vertically movable support structure.

8. The elevator arrangement according to claim 3, wherein the car guide rails extend continuously from below the vertically movable support structure above the vertically movable support structure.

9. The elevator arrangement according to claim 3, wherein the protective cover comprises a first opening through which the first guide rail extends, and a second opening through which the second guide rail extends.

10. The elevator arrangement according to claim 1, wherein said one or more displaceable cover parts of the protective cover include one or more displaceable cover parts, which extend over the first gap and/or over the second gap.

11. The elevator arrangement according to claim 1, wherein the one or more displaceable cover parts include a displaceable cover part extending between the first side wall and the first guide rail covering at least part of the gap formed between the first side wall and the first guide rail, and/or a displaceable cover part extending between the second side wall and the second guide rail and covering at least part of the gap formed between the second side wall and the second guide rail.

12. The elevator arrangement according to claim 1, wherein the one or more displaceable cover parts include in depth direction of the hoistway on both sides of the first guide rail, a displaceable cover part extending in a width direction of the hoistway closer to the first side wall than the first guide rail, and/or the one or more displaceable cover parts include in depth direction of the hoistway on both sides of the second guide rail, a displaceable cover part extending in the width direction of the hoistway closer to the second side wall than the second guide rail.

13. The elevator arrangement according to claim 1, wherein the protective cover comprises a second working platform, the protective cover being provided with a balustrade bordering a planar working area of the second working platform.

14. A method comprising the steps of:

providing an elevator arrangement as defined in claim 1; and thereafter using the elevator car for transporting passengers and/or goods; and thereafter hoisting the movable support structure higher in the hoistway; and thereafter using the elevator car again for transporting passengers and/or goods.

15. The method according to claim 14, wherein the method comprises, after said using and before said hoisting, displacing one or more displaceable cover parts of the protective cover for increasing free space beside the protective cover.

16. The method according to claim 15, wherein said displacing comprises displacing one or more displaceable cover parts of the protective cover, the one or more displaceable cover parts extending over the first and/or second gap.

17. The method according to claim 15, wherein said displacing comprises displacing a displaceable cover part extending between the first side wall and the first guide rail covering at least part of the gap fainted between the first side wall and the first guide rail, and/or displacing a displaceable cover part extending between the second side wall and the second guide rail and covering at least part of the gap formed between the second side wall and the second guide rail.

18. The elevator arrangement according to claim 4, wherein the protective cover extends between the first side wall and the first guide rail, covering at least part of the gap formed between the first side wall and the first guide rail, and/or between the second side wall and the second guide rail, covering at least part of the gap formed between the second side wall and the second guide rail.

19. The elevator arrangement according to claim 4, wherein the car guide rails extend continuously from below the vertically movable support structure above the vertically movable support structure.

* * * * *